US005464188A

United States Patent [19]

Priebe et al.

[11] Patent Number: 5,464,188

[45] Date of Patent: Nov. 7, 1995

[54] WELL PUMP BASE

[75] Inventors: W. F. Priebe, Midland; Ricky L. Foster; Michael C. Pierce, both of Odessa, all of Tex.

[73] Assignee: Atlantic Richfield Company, Los Angeles, Calif.

[21] Appl. No.: 206,365

[22] Filed: Mar. 7, 1994

[51] Int. Cl.[6] ..... F16M 1/00

[52] U.S. Cl. ..... 248/678; 248/676; 248/680; 248/670

[58] Field of Search ..... 248/346, 500, 248/670, 671, 678, 676, 680; 166/68, 75.1; 269/47, 52, 296, 208; 74/41

[56] References Cited

U.S. PATENT DOCUMENTS

| | | | |
|---|---|---|---|
| 1,799,160 | 4/1931 | Franks | 74/41 |
| 1,804,077 | 5/1931 | Backus et al. | 74/41 |
| 2,046,891 | 7/1936 | Andree et al. | 74/41 |
| 2,169,815 | 8/1939 | Patterson | 74/41 |
| 4,660,799 | 4/1987 | Butland | 248/676 |
| 4,700,923 | 10/1987 | Lewis et al. | 248/679 |

*Primary Examiner*—Blair M. Johnson
*Assistant Examiner*—Gwendolyn Wrenn
*Attorney, Agent, or Firm*—Roderick W. MacDonald

[57] ABSTRACT

A sucker rod well pump base that is readily movable and universally adjustable comprising at least two spaced apart footing members which carry, but are not connected to at least two spaced apart transverse support members. A plurality of spaced apart hold down members are carried along the length of the support members in an unconnected manner, but yet are restrained from movement away from the footing members by abutment of the hold down members against the support member. Each hold down member carries at least one tie down member for securing the base to a well pump unit.

11 Claims, 4 Drawing Sheets

WELL PUMP BASE

BACKGROUND OF THE INVENTION

When the pressure in an oil and gas reservoir has fallen to the point where a well will not produce oil and gas to the earth's surface by natural energy, some method of artificial lift is then employed. One of the most conventional types of artificial lift is sucker rod pumping wherein a pump at the bottom of the wellbore is reciprocated by a string of sucker rods that extend to the earth's surface and are there connected to a well pump unit. The pump unit at the earth's surface reciprocates the sucker rod string and the downhole pump thereby forcing fluid in the wellbore to the earth's surface for recovery.

A variety of sucker rod pump units are employed in practice, several of which are disclosed hereinafter in detail. However, all such units require a base which rests on the surface of the earth and upon which base is mounted the pump unit. This pump unit base is universally one or more concrete pads which have fixed therein and extending thereabove a plurality of iron bolts by which the pump unit is secured to the concrete base.

The problem with concrete bases becomes apparent when the pump unit is moved to another site. The base is extremely difficult to move. Even if the base is moved, the bottom configuration of the base is peculiar to the curvature of the earth where it was initially located and does not fit well with the curvature of the earth at the new location. Further, when a base is no longer useful, the concrete and iron contained therein is waste material which cannot be readily reused and must be disposed of in an acceptable manner at some cost.

This invention provides a pump unit base which is readily movable to any location and just as readily adjustable to the size and shape of any sucker rod well pumping unit in use today. When the base is of no further use, the material from which it is constructed can be reused and is not waste material in the manner of a concrete base.

SUMMARY OF THE INVENTION

In accordance with this invention, there is provided a sucker rod well pump base that is readily movable and adjustable. The pump base of this invention comprises at least two spaced apart footing or outrigger members. Each footing member has a plurality of adjustment apertures therein. The pump base also has at least two support members carried by the footing members in spaced apart relation and extending along the long axis of the pump unit to be supported. The support members extend across and rest upon the footing members but are not rigidly connected to the footing members. A plurality of easily removable restraint members are employed to coact between the support members and the adjustment apertures of the footing members. A plurality of spaced apart hold down members are employed along the length of the support members in a manner such that they are not connected to the support members but at the same time are restrained from movement in a direction away from the footing members by abutment of the hold down members against a portion of the support members. Each hold down member carries a tie down member for securing the pump base to the pump unit it supports.

The footing members can be spaced apart along the length of the support members depending on the length of the pump unit to be supported. The support members can be spaced apart along the length of the footing members depending on the width of the pump unit to be supported. The hold down members can be spaced along the length of the support members so they oppose corresponding hold down means already carried by the pump unit.

Various aspects, objects and advantages of this invention will be apparent to those skilled in the art from this disclosure and the appended claims.

DETAILED DESCRIPTION

Figure 1:
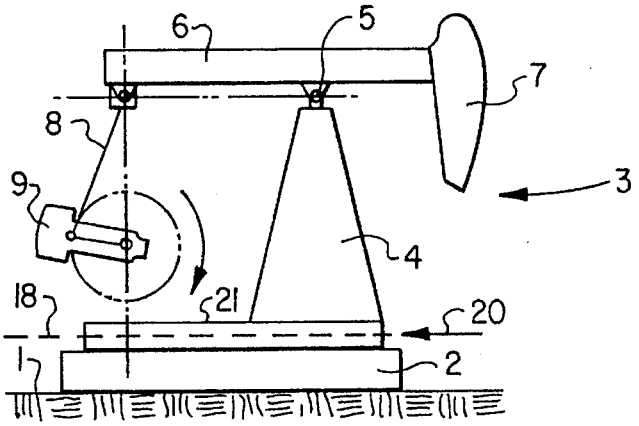
FIG. 1 (PRIOR ART)
FIGS. 1 through 4 show elevations of various well pumping units mounted on conventional concrete bases.

FIG. 1 shows the earth's surface 1 upon which rests a concrete well pump base 2. Resting on base 2 is a conventional sucker rod well pump unit 3 in simplified form. The basic components of pump unit 3 are the weight bearing sampson post 4 which is pivotally pinned at 5 to walking beam 6. One end of beam 6 carries horsehead 7 which supports a sucker rod string (not shown) that extends down into a wellbore (not shown) which contains a downhole pump (not shown). The opposing end of beam 6 is connected by way of pitman 8 to counterbalance 9. Counterbalance 9 is driven through a gear box (not shown) by a drive motor (not shown). In operation, the drive motor rotates counterbalance 9 which operates pitman 8 so as to pivot beam 6 up and down about fulcrum 5 thereby oscillating up and down horsehead 7 and the sucker rod string to which it is connected to achieve the desired pumping motion for the downhole pump.

Figure 2:
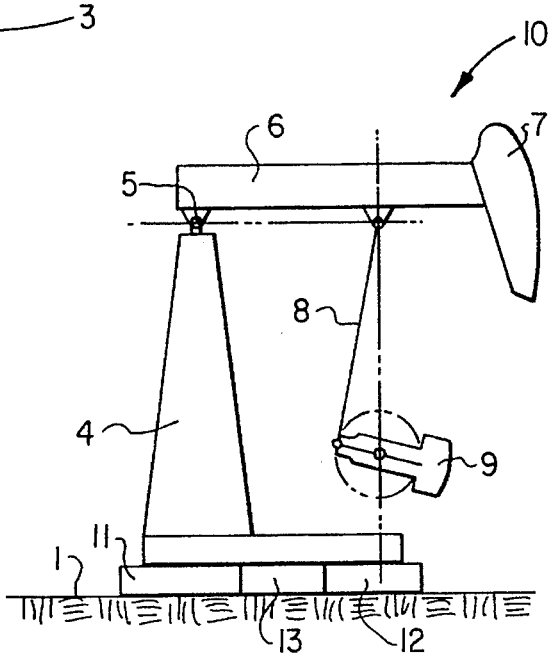
FIG. 2 (PRIOR ART)

FIG. 2 shows pump unit 10 to be a variation of pump unit 3 wherein counterbalance 9 and sampson post 4 are reversed in their location on walking beam 6 to achieve the same reciprocating pumping motion for horsehead 7. Normally, under this type of pumping unit, two separate concrete pads 11 and 12 are employed with an open space 13 therebetween.

Figure 3:
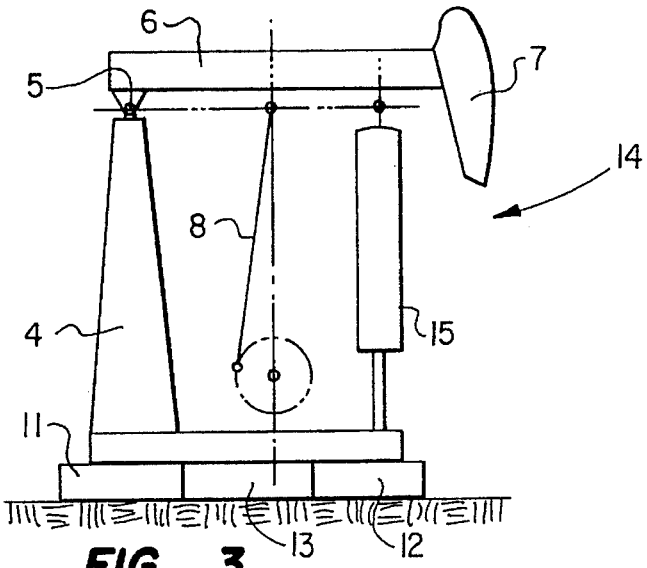
FIG. 3 (PRIOR ART)

FIG. 3 shows an air balanced pump unit 14 wherein sampson post 4 remains at the back end of the pumping unit but mechanical counterbalance 9 has been replaced by a pneumatic counterbalance 15. Air balanced system 14 can employ two separate concrete pads 11 and 12 with an open space 13 therebetween as in FIG. 2, or a single unitary concrete pad such as pad 2 of FIG. 1.

Yet, other variations of sucker rod well pump units, for example the rotoflex unit, are employed on concrete bases such as those shown in FIGS. 1 through 3.

The base of this invention can be adjusted to mate with any of the foregoing well pump units and other commercial units not disclosed herein. The base can be moved from well site to well site and reused with a number of different pump units for as long as there are well sites.

Figure 4:
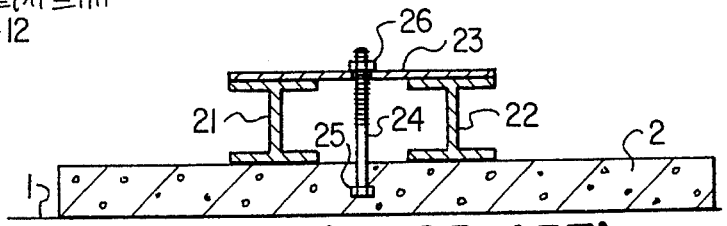
FIG. 4 (PRIOR ART)

FIG. 4 shows concrete base 2 viewed from the end of pumping unit 3 as indicated by arrow 20 in FIG. 1. FIG. 4 shows the base of pump unit 3 to be composed of a pair of spaced apart I-beams 21 and 22 which carry a plate 23 that is rigidly fixed, i.e., welded, to I-beams 21 and 22 and removably fixed to base 2 by way of threaded member 24. Member 24 is rigidly fixed in the concrete at 25 and removably secured to plate 23 by nut 26. This is the normal way for securing any of the pump units of FIGS. 1 through 3 to their respective concrete bases. It can be seen that when the pump unit is removed, all that remains is base 2 and a plurality of bolts 24 embedded therein neither of which are readily movable nor disposable.

Figure 5:
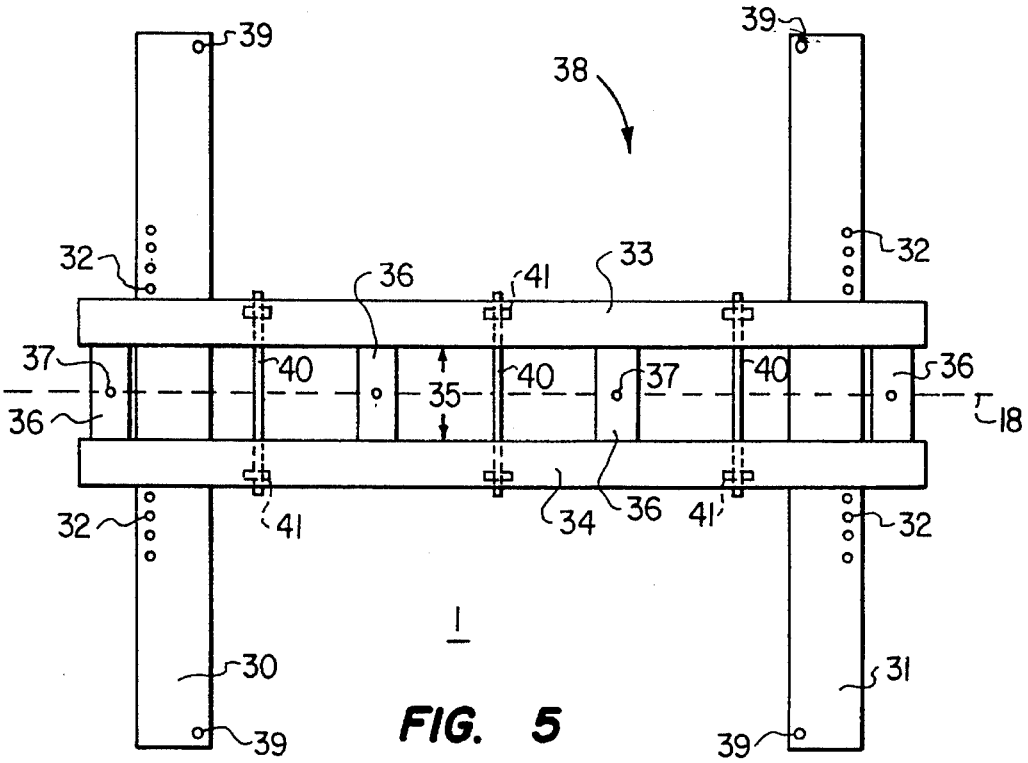
FIG. 5 shows a top view of one embodiment of a base within this invention.

FIG. 5 shows a movable, adjustable pump base within this invention to be composed of at least two footing members 30 and 31 which are spaced apart from one another and essentially parallel to one another. Parallelism of various members of the base of this invention is a convenience and not required for this invention. Footing members 30 and 31 extend transverse to the long axis 18 of, for example, pump unit 3 of FIG. 1.

Each footing member has a plurality of spaced apart adjustment apertures 32 extending along at least a central portion of the length thereof as shown in FIG. 5. These apertures are designed to receive a readily removable restraint member 19 (FIG. 7) which coacts with at least two spaced apart longitudinal support members 33 and 34 which rest on and are otherwise not fixed to the top of footing members 30 and 31. Accordingly, for example, members 33 and 31 are not connected except by means of removable restraint member 19.

Support members 33 and 34 extend along the long axis 18 of the pump unit and transverse across footing members 30 and 31. Support members 33 and 34 are spaced apart from one another a distance sufficient to match the distance between the supporting members of the pump unit, for example, members 21 and 22 of FIGS. 4 and 7. Thus, members 21 and 22 of FIG. 4 will rest on top of and along the length of support members 33 and 34 of FIG. 5. Support members 33 and 34 should be approximately, preferably at least, the length of support members 21 and 22 of pump unit 3 or any other pump unit which they support.

Space 35 between support members 33 and 34 is left open except for a plurality of spaced apart, preferably essentially parallel, hold down members 36. Hold down members 36 are not connected to support members 33 and 34 but are restrained from movement in a direction away from footing members 30 and 31, i.e., upwardly, by abutment of hold down members 36 against an upper flange or other protuberance on support members 33 and 34 as will be described in greater detail hereinafter. Each hold down member 36 carries a tie down member 37 for securing base 38 as a whole to the pump unit itself. For example, threaded tie down member 37 can be used in place of bolt 24 of concrete base 2 of FIG. 4, member 37 being fixed to plate 23 by way of nut 26.

It can be seen from the foregoing that footing members 30 and 31 can be spaced apart along the length of support members 33 and 34 based on the length of the pump unit to be supported. Of course, one or more additional footing members can be employed between footing members 30 and 31 if desired. Further, support members 33 and 34 can be spaced apart along the length of footing members 30 and 31 depending on the width of the pump unit to be supported. Finally, hold down members 36 are spaced along the length of support members 33 and 34 so that they oppose corresponding hold down means 23 already carried by the pump unit itself. This way, tie down members 37 are aligned with the apertures in the hold down means 23 carried by the pump unit itself. If desired, additional apertures 39 can be employed in one or more locations on footing members 30 and 31 to provide a location for receiving stabilizing means that are passed through apertures 39 and driven or set into earth 1 to help keep base 38 from moving laterally with respect to the earth from the location and orientation in which it is originally set.

Although not required for the efficient operation of base 38, additional rigidity can be provided to the base by employing a plurality of cross ties 40 between and along support members 33 and 34. Cross ties 40 secure support members 33 and 34 firmly against hold down members 36. Cross ties 40 are removably supported by means of nuts 41.

Figure 6:
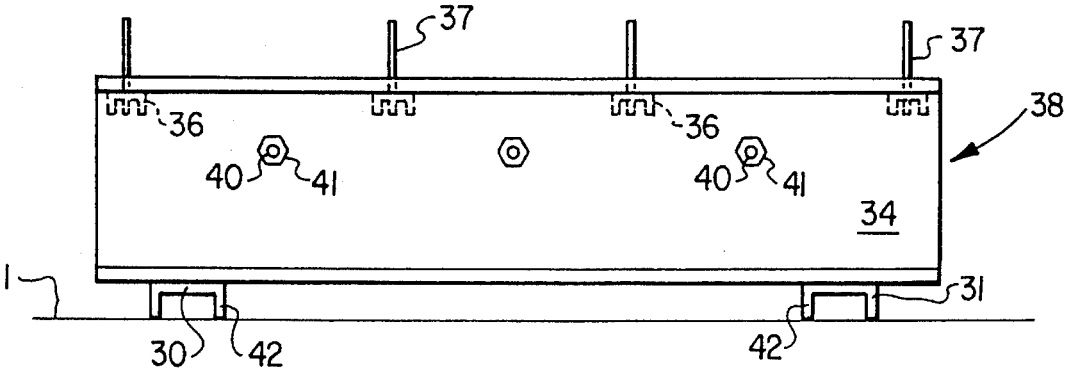
FIG. 6 is a side view of the base of FIG. 5.

FIG. 6 shows a side view of base 38 of FIG. 5. In operation, legs 42 provided by U-shaped channel beam footing member 31 would be embedded at least part way into the earth 1 thereby providing a stabilizing effect to base 38 whether an additional stabilizing means is employed through apertures 39 or not. Thus, footing members 30 and 31 may or may not carry a plurality of legs 42 that extend away from support member 34. Legs 42, if used, are preferably adapted to penetrate earth 1 at least to some extent.

Figure 7:
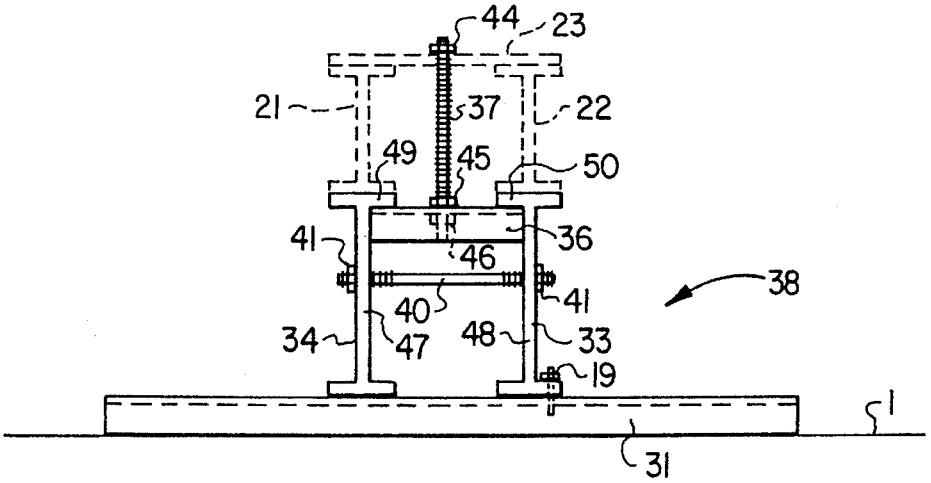
FIG. 7 is an end view of the base of FIG. 5.

FIG. 7 shows an end view of base 38 and further shows that support members 33 and 34 are desirably, but not necessarily, I-beams. It can be seen from FIG. 7 that support beams 33 and 34 are spaced apart the same distance as, for example, beams 21 and 22 of pump unit 3 and that tie down members 37 substitute for bolts 24 of concrete base 2 of FIG. 4. Pump unit 3 is secured to support members 33 and 34 by way of existing plates 23 and nuts 44. It can be seen that tie down members 37 are fixed to hold down members 36 by way of upper and lower nuts 45 and 46, member 37 being an all-thread device.

Support members 34 and 33 are shown, although not required, to be I-beams in FIG. 7 with cross tie 40 penetrating the upstanding webs 47 and 48 of members 34 and 33, respectively. The upper opposing flanges 49 and 50 of support members 34 and 33 serve as the upper abutting flange for hold down member 36 and thereby defines the upper limit to which hold down member 36 can move upwardly away from footing member 31. Support members 33 and 34 need not be I-beams but can be any sort of support beam which has a flange or protuberance that can serve like flanges 49 and 50, preferably running the length thereof, and against which hold down member 36 can abut. This way member 36 provides a well supported rigidly held foundation from which tie down member 37 can work against plate 23 of the pump unit, there being a plate 23 of the pump unit to match each hold down member 36 of base 38.

Figure 8:
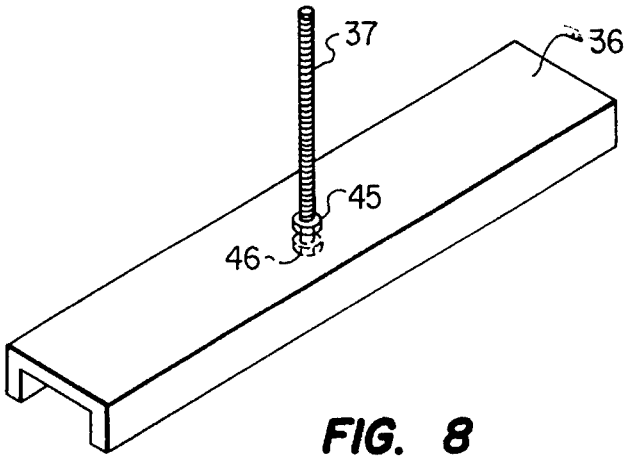
FIG. 8 is an isometric view of a hold down member of the base of FIG. 5.

FIG. 8 shows hold down member 36 carrying tie down member 37 and further shows that hold down member 36 in this embodiment is a U-shaped channel member.

Figure 9:
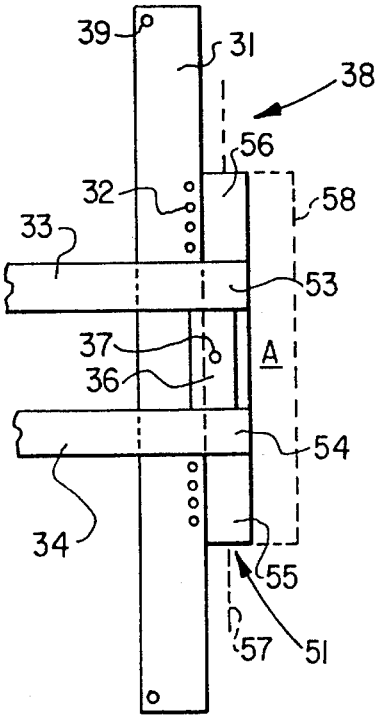
FIG. 9 shows a modification of the base of FIG. 9 wherein an extension device for the base of this invention is employed.
Figure 10:
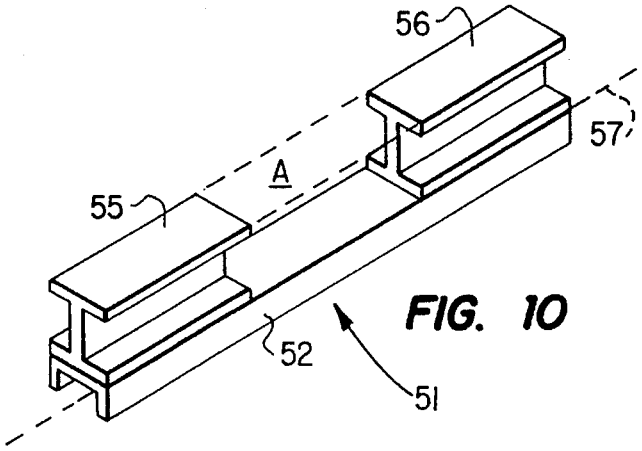
FIG. 10 shows an isometric view of the extension device of FIG. 9.

FIG. 9 shows base 38 modified at one end to receive an extension device within the scope of this invention. Extension device 51 can be seen from FIG. 10 to be composed of an additional footing member 52, having a long axis 57, that is transverse to and adjacent to ends 53 and 54 of support members 33 and 34, respectively. Additional footing member 51 carries at least one additional support member, such as support members 55 and 56, transverse to support members 33 and 34 and in essential alignment with long axis 57 of additional footing member 52. When extension device 51 is fitted as shown in FIG. 9, support members 55 and 56 abut side surfaces of ends 53 and 54 of support members 33 and 34 while additional footing member 52 abuts footing member 31.

As an alternative, extension device 51 can have a single, solid continuous support member along the length thereof in which case extension device 51 would be placed in the position marked A as outlined by dotted line 58. In such a case, the one piece additional support member would be of the same length as the additional footing member 52 and would abut the outer end surfaces of ends 53 and 54 rather than the side surfaces of ends 53 and 54 as shown in FIG. 9.

Figure 11:
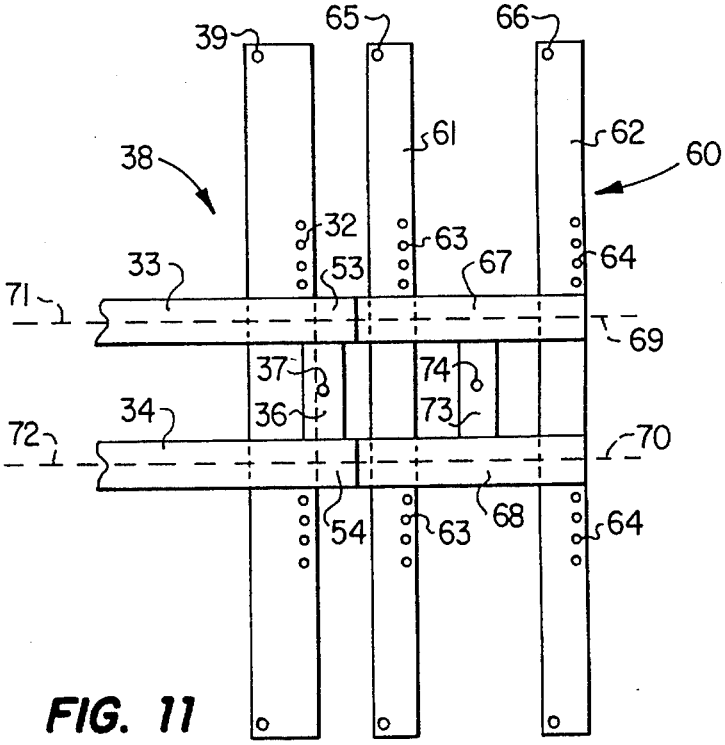
FIG. 11 shows a top view of the base of FIG. 5 with an extension unit added to one end thereof.

FIG. 11 shows an extension unit 60 employed at one end of base 38 to extend the length of base 38 substantially more than extension device 51, e.g., for an extra long pump unit.

Extension unit 60 is composed of at least two additional footing members 61 and 62 having adjustment apertures 63 and 64 and restraining apertures 65 and 66, respectively, and at least two additional support members 67 and 68 which have their long axes 69 and 70 in essential alignment with the long axes 71 and 72 of support members 33 and 34. Extension unit 60 thus has its additional footing members and additional support members arranged relative to one another in the same manner as pump base 38. Extension unit 60 also has at least one additional hold down member 73 and tie down member 74 for use in the same manner as hold down member 36 and tie down member 37.

Figure 12:
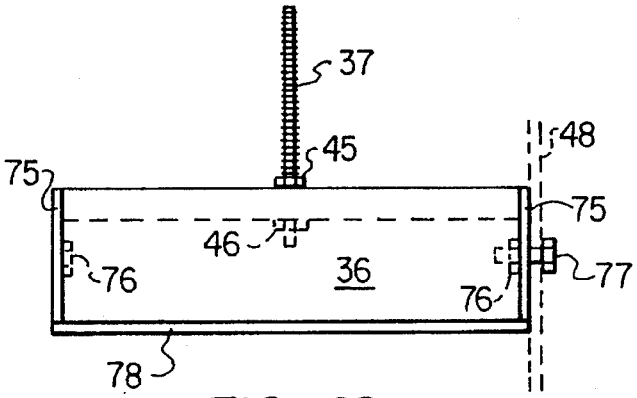
FIG. 12 shows one embodiment of a hold down member within this invention which is rigidly securable in a removable manner to the support members to provide a fixed support for any part of the pump unit which is narrower than the spacing between the support members.

FIG. 12 shows a modification of hold down member 36 wherein that member is more rigidly securable, in a removable manner, to the upstanding webs 48 and 47 of support members 33 and 34, respectively. Only upstanding web 48 is shown in FIG. 12, both webs being shown in FIG. 14. By so securing one or more hold down members 36, a fixed support means is provided for a load carrying capacity for any part of the pump unit which is narrower than spacing 35 between support members 33 and 34. This can become important in connection with certain conventional pump units because the gear and counterweight portion of the pump unit can be of a certain width whereas the drive motor portion which extends behind the gear and counterweight portion can be narrower simply because the drive motor is a smaller piece of equipment. When this is the case, the drive motor can fall in the space 35 between support members 33 and 34. In such a situation a hold down member 36 which is more rigidly secured to support members 33 and 34 is necessary to provide a downward force load bearing support means for the narrower drive motor.

Hold down member 36 can be made into a fixed support means in any number of ways obvious to those skilled in the art. FIG. 12 showing but one of them. In FIG. 12, hold down member 36 has a reinforcing plate 75 welded to both ends thereof. Plate 75 has an aperture therein around which is welded nut 76. An optional bottom welded reinforcing plate 78 can also be employed if desired. The reinforced hold down member 36 can be fixed to the upstanding webs 48 and 47 of support members 33 and 34 as shown, for example, in FIG. 12 with bolt 77 passing through web 48 and engaging nut 76 to fix hold down member 36 rigidly against web 48 in a removable manner. Bolt 77 will hold member 36 in place even if a downward force is applied thereto by a portion of the pump unit.

Figure 13:
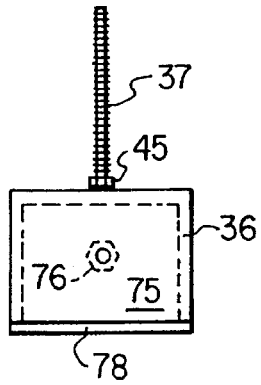
FIG. 13 is an end view of the hold down member of FIG. 12.

FIG. 13 shows an end view of the apparatus of FIG. 12 with bolt 77 and web 48 removed.

Figure 14:
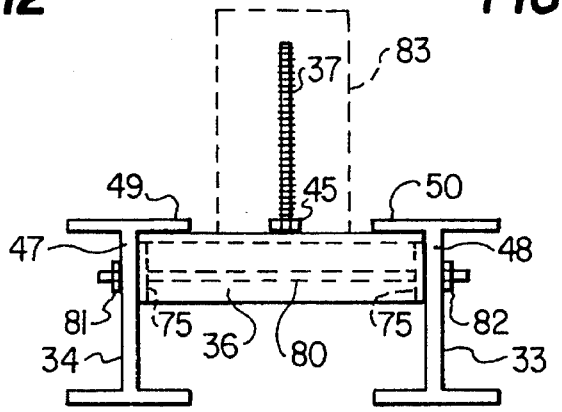
FIG. 14 is yet another embodiment of a rigidly securable hold down member within this invention as secured within a pair of support members.

FIG. 14 shows yet another embodiment for a fixed support means within this invention wherein hold down member 36 has reinforcing plates 75 welded thereto with an aperture therein but with no nut 76 welded thereto. In this embodiment, no bottom reinforcing plate 78 is employed either. The thus reinforced hold down member 36 is mounted between support members 33 and 34 to abut upstanding webs 48 and 47 and further to abut the under side of the upper opposing flanges 49 and 50 of support members 34 and 33. An elongate rod such as an all-thread bar 80 extends through web 47 along the length of hold down member 36 and through web 48. Rod 80 is then rigidly secured by means of nuts 81 and 82 to provide a fixed downward load bearing support means which will support a drive motor of the size shown by dotted line 83.

Figure 15:
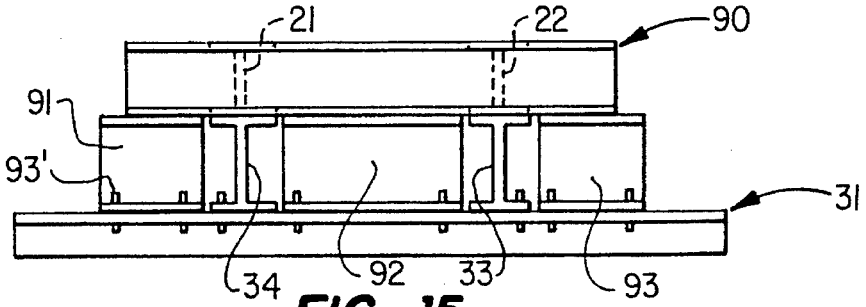
FIG. 15 shows another embodiment wherein transverse support members are employed in areas where the base of a pump unit is wider than normal.

FIG. 15 shows a front view of a pump base composed of standard I-beams 21 and 22 but which has in addition a transverse (to long axis 18 for example of pump unit 3) I-beam member 90 that is fixed to I-beams 21 and 22 and an integral part of the pump unit base that rests on support members 33 and 34 of this invention. To provide better support for transverse pump base member 90 since it extends laterally a substantial distance beyond support members 33 and 34, one or more transverse support members 91, 92, and 93 can be employed outside support members 33 and 34 as is the case for transverse support members 91 and 93 or therebetween in the case of member 92. Members 91–93 can be I-beams like members 33 and 34. Such transverse support can be employed at a plurality of locations along the length of the pump unit base where ever it extends laterally a substantial distance beyond members 33 and 34. Members 91–93 can be fixed to footing member 31 by removable pins or bolts 93'.

Figure 16:
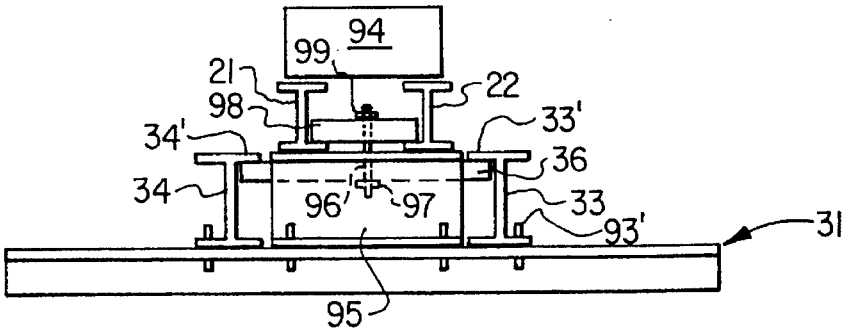
FIG. 16 shows an embodiment wherein a transverse support member is employed in areas where the base of a pump unit is narrower than normal.

FIG. 16 shows the other extreme from FIG. 15 wherein a portion of the pump unit base is narrower than the distance between support members 33 and 34 and therefore is unsupported between members 33 and 34. This can occur, for example, where an electric or other power motor is carried at the rear of the pump unit for powering the pump unit itself and the like. In FIG. 16 pump unit base I-beams 21 and 22 fall between support members 33 and 34 in the area where those beams 21 and 22 support motor 94. For most of the length of members 33 and 34 beams 21 and 22 may rest on top thereof as shown in FIG. 7 so the pump unit base is well supported. However, in the vicinity of motor 94 the beams 21 and 22 are disposed closer to one another in order to support narrower motor 94. In such a case they are no longer resting on members 33 and 34. Beams 21 and 22 under motor 94 may be well supported by those portions of beams 21 and 22 which in other places along their length rest on members 33 and 34 as shown in FIG. 7, but in the narrowed zone under motor 94 are suspended over air and in need of some stabilizing and/or additional support. This function is provided by one or more additional transverse support members 95 which rest on footing member 31 and abut the underside of beams 21 and 22. Beams 21 and 22 are fixed to longitudinal support members 33 and 34 and to transverse support member 95 by one or more hold down means composed of one or more hold down members 36 which are carried in contact with the underside of inner flanges 33' and 34' by removable threaded rod 96 which passes through and is removably secured to member 36 by lower nut 97 and member 98 abuts the top side of the inner flanges of I-beams 21 and 22 and is removably secured to rod 96 by way of upper nut 99. Member 95 can be an I-beam and member 36 can be positioned to bear against the underside of a flange of I-beam 95 just as member 36 bears against the underside of flanges 33' and 34' thereby providing substantial support and stabilization for motor 94. Of course, if the entire pump unit base happens to be narrower than the span between support members 33 and 34 and not just where motor 94 is mounted the transverse support member 95 and related tie down apparatus 96–99 can be used over the entire length of the narrow pump unit base thereby eliminating the need for moving support members 33 and 34.

As noted earlier herein additional footing members 31 can be placed anywhere along the pump unit base length to accommodate the transverse support members 91–93 and 95 any where the pump unit base is too wide or too narrow for the existing span between members 33 and 34.

It can be seen from the foregoing that the sucker rod well pump base of this invention is highly mobile in that it can be readily broken down into its component parts for movement and reassembled easily in the field. Further, it is universally adapted for essentially all well pump units currently working in the oil patch. Finally, its component parts can be reused in other applications rather than disposed of as waste material.

Reasonable variations and modifications are possible within the scope of this disclosure without departing from the spirit and scope of this invention.

What is claimed is:

1. A pump base that is readily moveable from site to site and readily adjustable to various types of pump units, each such pump unit having a long axis, the pump base comprising at least two elongated footing members spaced apart from another, each of said footing members having a plurality of spaced apart adjustment apertures extending along at least a central portion thereof, at least two elongated support members spaced apart from one another and extending transversely to said footing members, said support members extending across and resting upon but not connected to said footing members, said support members being restrained from lateral movement with respect to said footing members by a plurality of restraint members that coact with said support members and said adjustment apertures, a plurality of spaced apart hold down members along the length of said support members, said hold members being unconnected to said support members but restrained from movement in a direction away from said footing members by abutment of said hold down members against a portion of at least two of said support members, each said hold down member carrying a tie down member for securing said pump base to said pump unit, whereby said footing members can be spaced apart along the length of said support members depending on the length of said pump unit, said support members can be spaced apart along the length of said footing members depending on the width of said pump unit, and said hold down members can be spaced along the length of said support members so they oppose corresponding hold down means already carried by said pump unit.

2. The apparatus according to claim 1 wherein said support members which abut said hold down members each carry flange along the length thereof, hold down members abutting said flange to restrain said hold down members from moving any further away from said footing members.

3. The apparatus according to claim 1 wherein said footing members carry a plurality of legs that extend away from said support members, said legs being adapted to penetrate the earth upon which said footing members are placed.

4. The apparatus according to claim 1 wherein a plurality of cross ties are employed between and along said support members against which said hold down members abut, said cross ties forcing said support members against said hold down members.

5. The apparatus according to claim 1 wherein said hold down members are I-beams, and said hold down members abut both the upstanding web of both I-beams and the underside of the upper opposing flanges of both I-beams.

6. The apparatus according to claim 1 wherein at least one end of said base carries an extension device composed of an additional footing member having a long axis that is transverse to and adjacent to the ends of said support members against which said hold down members abut, said additional footing member carrying at least one additional support member which is transverse to said support members and in essential alignment with said long axis of said additional footing member.

7. The apparatus according to claim 1 wherein at least one of said hold down members is rigidly securable in a removable manner to the support members which it abuts in order to provide fixed support means for carrying any part of said pump unit which is narrower than the spacing between said support members.

8. The apparatus according to claim 1 wherein adjacent at least one end of said pump base there is disposed an extension unit composed of at least two additional footing members and at least two additional support members arranged relative to one another in the same manner as said pump base, said at least two additional support members having their long axes in essential alignment with the long axes of said pump base support members, and at least one additional hold down member-tie down member combination.

9. The apparatus according to claim 5 wherein said footing members and hold down members are U-shaped channel beams.

10. The apparatus according to claim 1 wherein said footing members are essentially parallel with one another and have a plurality of apertures therein for receiving stabilizing means which pass through said apertures and into the earth upon which said footing members rest, said support members are essentially parallel to one another, and said hold down members are essentially parallel to one another.

11. The apparatus according to claim 1 wherein at least one support member is employed transverse to said long axis to accommodate any portion of said pump unit which is narrower or wider than the existing span between said support members which extend along said long axis.

* * * * *